US011655741B2

(12) United States Patent
Minato et al.

(10) Patent No.: US 11,655,741 B2
(45) Date of Patent: May 23, 2023

(54) MUFFLER FOR ENGINE

(71) Applicant: Marelli Corporation, Saitama (JP)

(72) Inventors: Tsukasa Minato, Saitama (JP); Masayuki Hara, Saitama (JP); Noriyoshi Sasaki, Saitama (JP); Nobuhiro Saitou, Saitama (JP)

(73) Assignee: Marelli Corporation, Saitama (JP)

( * ) Notice: Subject to any disclaimer, the term of this patent is extended or adjusted under 35 U.S.C. 154(b) by 335 days.

(21) Appl. No.: 17/056,493

(22) PCT Filed: Mar. 28, 2019

(86) PCT No.: PCT/JP2019/013577
§ 371 (c)(1),
(2) Date: Nov. 18, 2020

(87) PCT Pub. No.: WO2019/225149
PCT Pub. Date: Nov. 28, 2019

(65) Prior Publication Data

US 2021/0199035 A1 Jul. 1, 2021

(30) Foreign Application Priority Data

May 22, 2018 (JP) ..... JP2018-097581

(51) Int. Cl.
*F01N 1/02* (2006.01)
*F01N 13/18* (2010.01)
*G10K 11/16* (2006.01)

(52) U.S. Cl.
CPC ..... *F01N 1/026* (2013.01); *F01N 13/1805* (2013.01); *F01N 13/1838* (2013.01); *G10K 11/161* (2013.01)

(58) Field of Classification Search
CPC .. F01N 1/026; F01N 13/1805; F01N 13/1838; F01N 2450/22; G10K 11/161
See application file for complete search history.

(56) References Cited

U.S. PATENT DOCUMENTS

| | | | | |
|---|---|---|---|---|
| 7,735,602 | B2 * | 6/2010 | Yasuda | F01N 13/1805 181/227 |
| 7,913,811 | B2 | 3/2011 | Andre et al. | |
| 7,926,615 | B2 | 4/2011 | Smatloch et al. | |
| 2019/0211737 | A1 * | 7/2019 | Hayakawa | G10K 11/162 |

FOREIGN PATENT DOCUMENTS

| | | | |
|---|---|---|---|
| JP | H07259531 | A | 10/1995 |
| JP | H0755288 | Y2 | 12/1995 |
| JP | 2017141733 | A * | 8/2017 |
| WO | 2017159344 | A1 | 9/2017 |

* cited by examiner

*Primary Examiner* — Jeremy A Luks
(74) *Attorney, Agent, or Firm* — Young Basile Hanlon & MacFarlane, P.C.

(57) ABSTRACT

A muffler for an engine includes a muffler body, at least one partition wall, and at least one reinforcing plate. The muffler body has an inner space formed by a shell. The partition wall includes a flange portion which is in tight contact with an inner surface of the shell, and the partition wall divides the inner space of the muffler body into a plurality of chambers. The reinforcing plate is welded on an outer surface of the shell at a position facing the flange portion of the partition wall.

7 Claims, 5 Drawing Sheets

MUFFLER FOR ENGINE

CROSS-REFERENCE TO RELATED APPLICATION(S)

This application claims priority to Japanese Patent Application No. 2018-097581 filed May 22, 2018, which is incorporated herein by reference.

TECHNICAL FIELD

The present invention relates to a muffler for an engine intended to reduce the radiated sound from a muffler body (shell).

BACKGROUND

As a muffler (silencer) used in the engine of a vehicle such as an automobile, a press muffler obtained by press-forming a metal plate is widely used. The press muffler is generally formed by pressing a thin metal plate of about 1 mm to 1.5 mm. In this type of muffler, the wall thickness of the shell is increased or the shell is formed into a two-layer structure in order to suppress the increase of the radiated sound from the shell.

For example, U.S. Pat. No. 7,913,811B describes a single-shell press muffler having a structure in which a single-layer shell (muffler body) and a baffle plate are joined. U.S. Pat. No. 7,926,615B describes a double-shell press muffler having a structure in which a two-layer shell and a baffle plate are joined.

SUMMARY

Incidentally, although the single-shell press muffler described in U.S. Pat. No. 7,913,811B is light and low-cost when the muffler size is increased and the muffler shape is flattened, there are problems of radiated sound and inner pressure strength. Thus, such single-shell press muffler does not work as a muffler.

The double-shell press muffler described in U.S. Pat. No. 7,926,615B has advantages in terms of strength and effect of low radiated sound due to its frictional damping effect. However, it has disadvantages in terms of cost and weight.

An object of the present invention is to provide a muffler for an engine wherein the muffler can reduce the muffler radiated sound, improve the strength, and reduce the weight.

According to the first aspect of the present invention, a muffler for an engine includes a muffler body, at least one partition wall, and at least one reinforcing plate. The muffler body has an inner space formed by a shell. The partition wall includes a flange portion that is in tight contact with an inner surface of the shell, and divides the inner space of the muffler body into a plurality of chambers. The reinforcing plate is welded on an outer surface of the shell at a position facing the flange portion of the partition wall.

According to the above configuration, the muffler for the engine can reduce the muffler radiated sound, improve the strength, and reduce the weight, by welding the reinforcing plate on the outer surface of the shell at a position facing the flange portion of the partition wall.

DETAILED DESCRIPTION

Embodiments will be described below with reference to the drawings.

Figure 1:
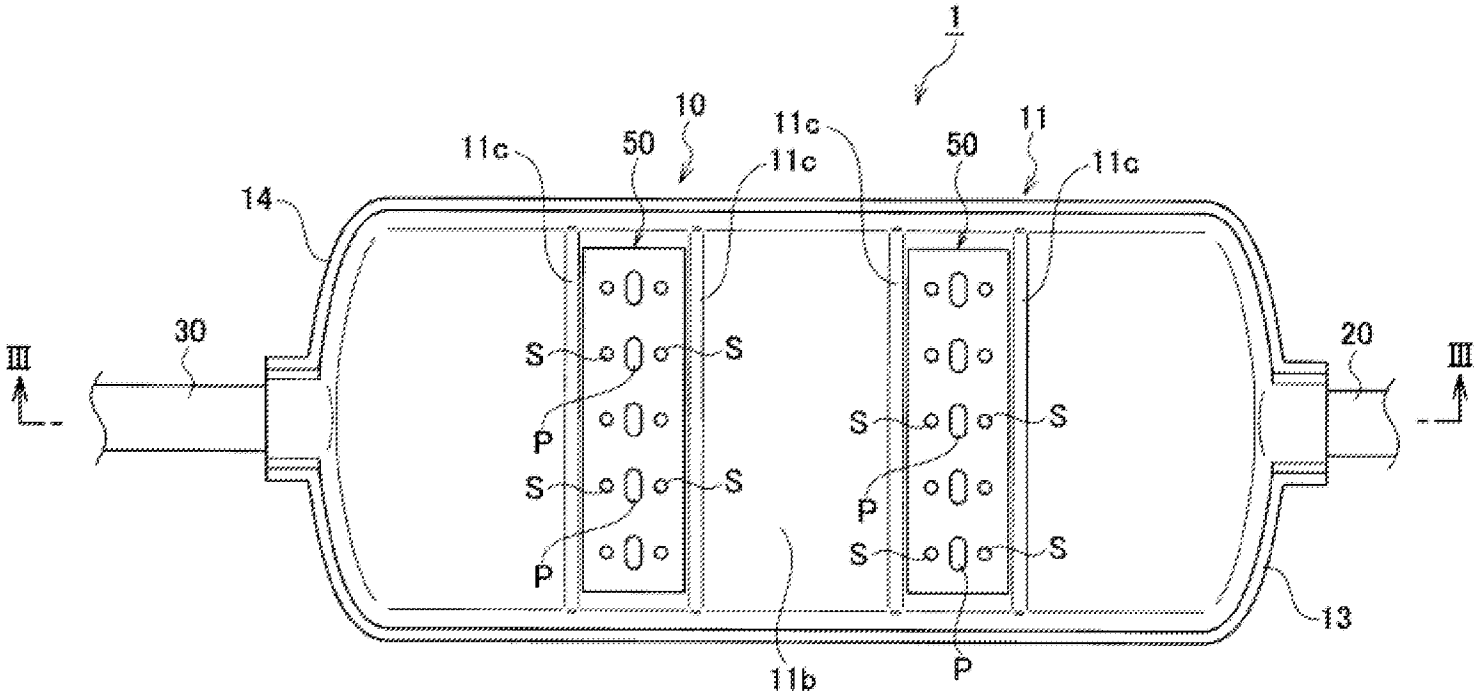
FIG. 1 is a plane view of a muffler for an engine according to an embodiment.
Figure 2:
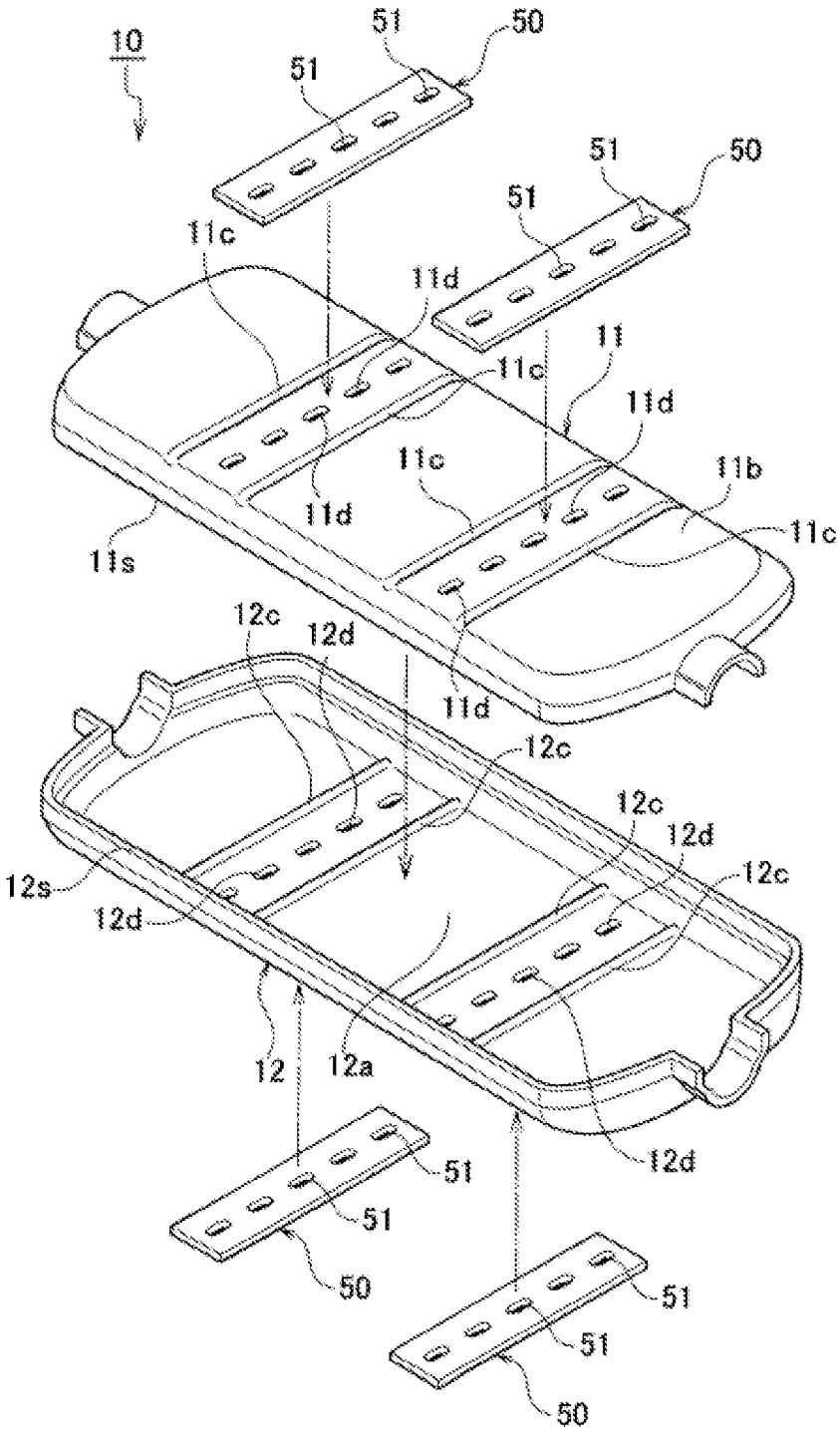
FIG. 2 is an exploded perspective view of a muffler body used in the muffler for the engine.
Figure 3:
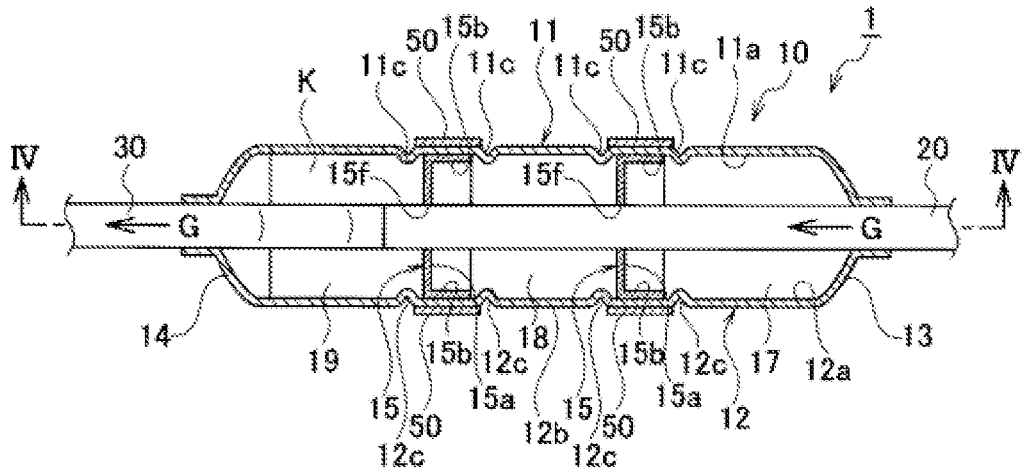
FIG. 3 is a cross-sectional view taken along the line in FIG. 1.
Figure 4:
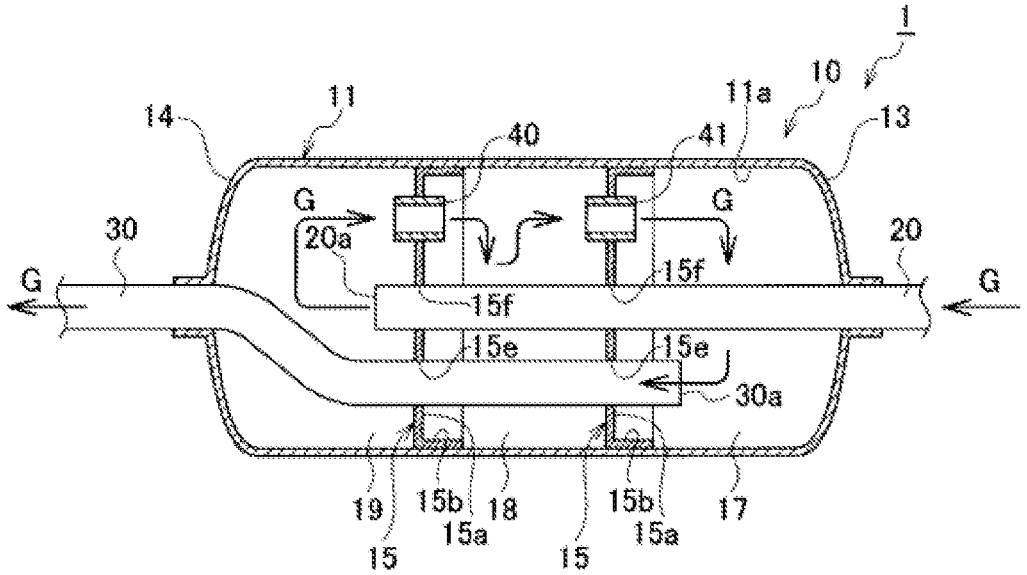
FIG. 4 is a cross-sectional view taken along the IV-IV line in FIG. 3.
Figure 5:
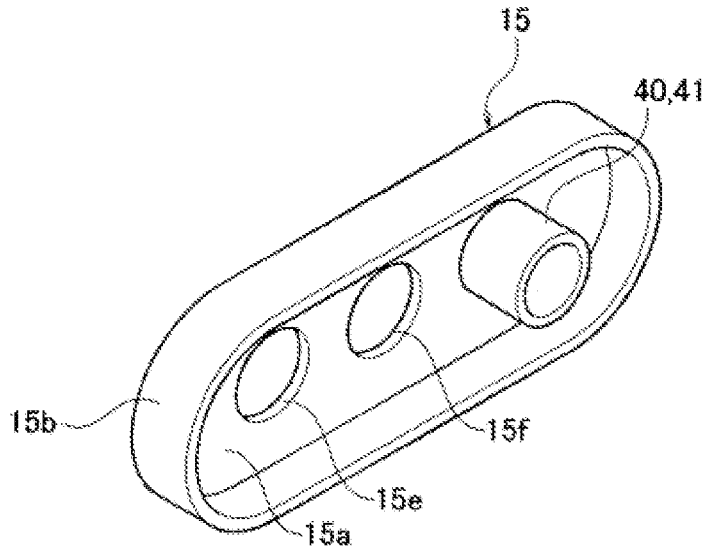
FIG. 5 is a perspective view of a partition wall used in the muffler for the engine.
Figure 6:
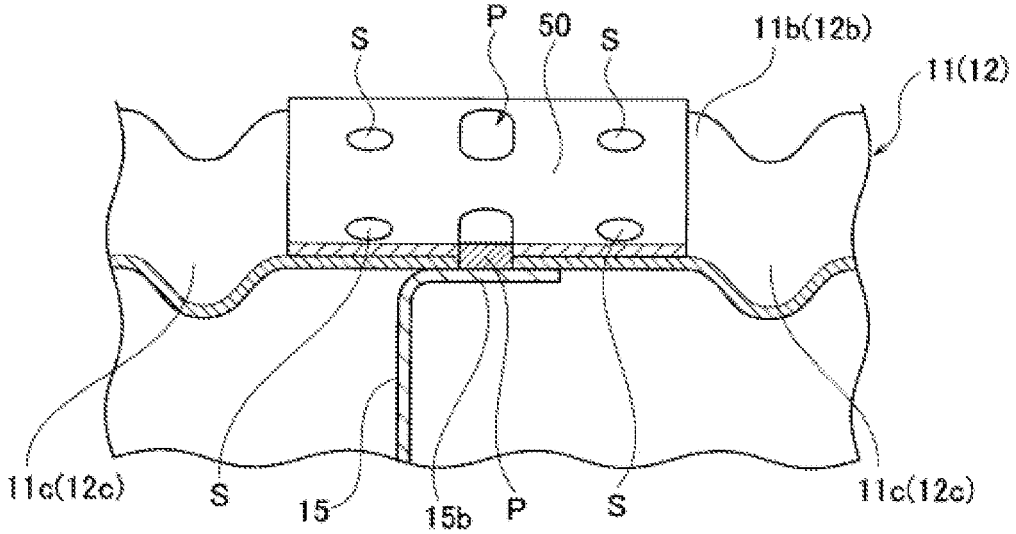
FIG. 6 is a partial perspective view showing a three-layer bonding structure of a flange portion of the partition wall, a shell and a reinforcing plate, partially in a cross section.
Figure 7:
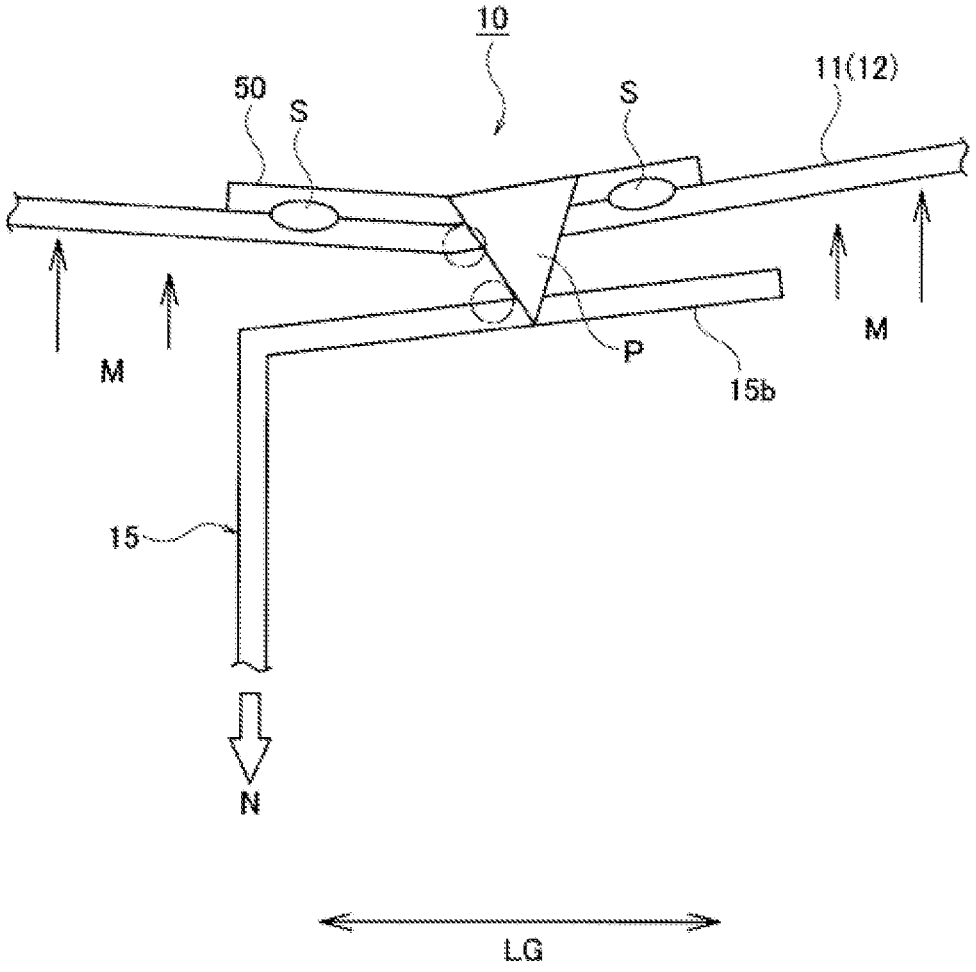
FIG. 7 is an explanatory view showing a deformation-suppressing-state after the three-layer bonding of the flange portion of the partition wall, the shell, and the reinforcing plate.

FIG. 1 is a plane view of a muffler for an engine according to an embodiment; FIG. 2 is an exploded perspective view of a muffler body used in the same muffler; FIG. 3 is a cross-sectional view taken along the line in FIG. 1; FIG. 4 is a cross-sectional view taken along the IV-IV line in FIG. 3; FIG. 5 is a perspective view of a partition wall used in the same muffler; FIG. 6 is a partial perspective view showing a three-layer bonding structure of a flange portion of the same partition wall, a shell, and a reinforcing plate, partially in cross-section; FIG. 7 is an explanatory view showing a deformation-suppressing-state after the three-layer bonding of the flange portion of the partition wall, the shell, and the reinforcing plate.

As shown in FIGS. 1, 3, and 4, a muffler 1 for an engine is a press muffler obtained by press-forming a metal plate and attached to an exhaust pipe of the engine not shown. The muffler 1 for the engine comprises a muffler body 10, an upstream exhaust pipe 20 connected to an end side in the longitudinal direction LG of the muffler body 10, and a downstream exhaust pipe 30 connected to the other end side in the longitudinal direction LG.

As shown in FIGS. 2 and 3, opposing peripheral edges 11*s* and 12*s* of two shells 11 and 12 are joined by welding or caulking together. Thereby the muffler body 10 is formed in a bag shape which is flat other than the opposing peripheral edges 11*s* and 12*s* of substantially long elliptical cross section having an inner space K. The two shells 11 and 12 are made, for example, by pressing a metal sheet having a thickness of 0.8 mm. The shell 11 is the upper half-cylinder plate and the shell 12 is the lower half-cylinder plate, which respectively correspond to the muffler body 10 divided in half. The inner space K of the muffler body 10 is divided into a plurality of expansion chambers 17, 18 and 19 by a plurality of baffle plates 15 each having a flange portion 15*b* in tight contact with an inner surface 11*a*/12*a* of each shell 11/12.

Further, as shown in FIGS. 3 and 4, a tip 20*a* of the upstream exhaust pipe 20 penetrates an endplate portion 13 at an end side and communicates with the expansion chamber 19 at the other end side, passing through through-holes 15*f* of the baffle plates 15. A tip 30*a* of the downstream exhaust pipe 30 penetrates an endplate portion 14 at the other end side and communicates with the expansion chamber 17 at the end side, passing through through-holes 15*e* of the baffle plates 15. Further, the adjacent expansion chambers 17, 18, and 19 communicate with each other through communication pipes 40 and 41 passing through the baffle plates 15. Thus, the exhaust gas G introduced from the upstream exhaust pipe 20 exits from the downstream exhaust pipe 30 in the arrow's route in the drawing through the communication pipes 40 and 41. The sound is reduced while the exhaust gas G passing through the respective chambers 17, 18 and 19.

As shown in FIG. 5, the baffle plate 15 has a plate body 15*a* perpendicular to the inner surface 11*a* of the shell 11, and a short cylindrical flange portion 15*b* extending along the inner surface 11*a* of the shell 11 from the periphery of the plate body 15*a* in the axial direction (the longitudinal direction LG of the muffler body 10). A reinforcing plate 50 is welded on an outer surface 11*b*/12*b* of each shell 11/12 at a position facing the position where the flange portion 15*b* of the baffle plate 15 is provided. The reinforcing plate 50 is, for example, a rectangular metal plate having a thickness of 1 mm, and the thickness of the baffle plate 15 is, for example, 1.2 mm.

Furthermore, as shown in FIGS. 1 to 3, in each shell 11/12, recessed grooves 11*c*/12*c* in each pair are formed in parallel along a direction perpendicular to the longitudinal direction LG of the muffler body 10. The recessed grooves 11*c*/12*c* are recessed in a U-shape from the outer surface 11*b*/12*b* side to the inner surface 11*a*/12*a* side. In the longitudinal direction LG of the muffler body 10, the recessed grooves 11*c*/12*c* in each pair are located on both end sides in the axial direction of the flange portion 15*b* of each baffle plate 15. The rectangular-shaped reinforcing plate 50 having a width equal to or broader than the width of the flange portion 15*b* of the baffle plate 15, is joined to each outer surface 11*b*/12*b* between the recessed grooves 11*c*/12*c* in each pair, by two types of welding, which are spot welding and plug welding. In the present embodiment, the reinforcing plate 50 is joined so as to cover all the positions facing the flange portion 15*b* of the baffle plate 15.

The bonding procedure by welding the three-layer bonding structure of the flange portion 15*b* of the baffle plate 15, the shell 11/12, and the reinforcing plate 50, shown in FIG. 6, will be described in detail. First, as shown in FIG. 2, a plurality of long holes 51 is formed at equal intervals in the widthwise center of the rectangular-shaped reinforcing plate 50 along its longitudinal direction. Further, a plurality of long holes 11*d*/12*d* is formed at equal intervals in the center of each pair of the recessed grooves 11*c*/12*c* of the shell 11/12, so as to face the respective long holes 51 of the reinforcing plate 50.

Then, the rectangular-shaped reinforcing plate 50 is piled and attached on the outer surface 11*b*/12*b* of the shell 11/12, between the recessed grooves 11*c*, 12*c* in each pair, in a state where the respective long holes 11*d*/12*d* of the shell 11/12 and the respective long holes 51 of the reinforcing plate 50 are aligned. Then, both sides of the widthwise center of the reinforcing plate 50 with the formed long holes 51 are respectively joined by spot welding to the shell 11/12 (this welded portion is indicated by reference numeral S) at equal intervals at a plurality of places (in this embodiment, one side five places, a total of 10 places) along the longitudinal direction, in advance.

Next, the rectangular-shaped reinforcing plate 50 is joined to the flange portion 15*b* of the baffle plate 15 across the shell 11/12 via the respective long holes 51, 11*d*/12*d* by plug welding (this welded portion is indicated by reference numeral P in the drawing) at equal intervals at a plurality of places (five places in this embodiment). Thus, the three-layer bonding structure of the flange portion 15*b* of the baffle plate 15, the shell 11/12, and the reinforcing plate 50 is formed as shown in FIG. 6.

In the muffler body 10 of the muffler 1 for the engine, having such a configuration, when the inner pressure load M of the mechanical load caused by gas pressure or thermal load or vibration input acts on the shells 11 and 12 being a press muffler, the tension N is applied to the baffle plate 15 by the reaction, as shown in FIG. 7. However, it is possible to suppress the deformation near the welded portion P of the flange portion 15*b* of the baffle plate 15 and the shell 11/12 by the three-layer bonding structure of the flange portion 15*b* of the baffle plate 15, the shell 11/12 and the reinforcing plate 50, as shown in FIG. 6. Furthermore, it is possible to reliably prevent cracking and breakage of the flange portion 15*b* of the baffle plate 15 and the shell 11/12 from the welded portion P because the concentration of strain is dispersed and mitigated. As a result, it is possible to improve the strength of the shell 11/12 against gas pressure and thermal load and vibration input. At the same time, it is possible to reduce the weight of the muffler body 10 by reducing the thickness of the single layer portion of the shell 11/12.

Further, the jointed portion of the shell 11/12 and the flange portion 15*b* of the baffle plate 15, serving as a node of the vibration mode of the muffler body 10, is held by a rectangular-shaped reinforcing plate 50 having a width wider than the flange portion 15*b* not only the point portion of the welded portion P. Therefore, it is possible to reduce the muffler radiated sound because the vibration amplitude of the shells 11/12 is reduced. That is, as compared with the things to achieve the damping effect due to two-layering or the stiffness increase due to the thickness increase of the shell 11/12, it is possible to reduce radiated sound efficiently through vibration amplitude suppressing effect in the shell 11/12 caused by the reinforcing plate 50, without increasing weight.

Furthermore, as shown in FIG. 2, it is possible to reduce the cost through reduced number of parts as the muffler body 10 having an inner space K is formed by joining the opposing peripheral edges 11*s* and 12*s* of the upper and lower two shells 11 and 12 by welding or caulking together.

In the above embodiment, the number of baffle plates (partition wall) is two. However, the number of the baffle plates and the number of the chambers partitioned by the baffle plates are not limited to this, and the number of the reinforcing plates is not limited to two. Furthermore, although the shell and the reinforcing plate are welded in advance by spot welding, they may be welded by TIG welding or MIG welding or the like.

Thus, the present invention can include various embodiments and the like not described herein. Therefore, the technical scope of the present invention is defined only by the matters specifying the invention regarding the following claims that are reasonable from the above description.

The invention claimed is:

1. A muffler for an engine, comprising:

a shell that defines a muffler body having a flat profile and an inner space divided into a plurality of chambers by a partition wall with a flange portion in tight contact with an inner surface of the shell;

a reinforcing plate in rectangular shape at a position on an outer surface of the shell facing the flange portion of the partition wall;

a pair of spot welds on opposing sides of a longitudinal axis of the reinforcing plate welding the reinforcing plate to the shell; and a plug weld positioned between the pair of spot welds welding the reinforcing plate, the flange portion, and the shell.

2. The muffler for the engine according to claim 1, wherein the muffler body is a press muffler, and the pair of spot welds is a plurality of pairs of spot welds, wherein the plurality of the pairs of spot welds are spaced along a longitudinal direction of the reinforcing plate, so as to cover multiple positions facing the flange portion of the partition wall, on the outer surface of the shell being the press muffler.

3. The muffler for the engine according to claim 1, wherein the pair of spot welds is a plurality of pairs of spot welds that are positioned along the longitudinal axis of the reinforcing plate to join the shell at a plurality of places by spot welding.

4. The muffler for the engine according to claim 3, wherein the reinforcing plate is joined to the flange of the partition wall at a plurality of places with a respective plug weld between each of the plurality of the pairs of spot welds.

5. The muffler for the engine according to claim 1, wherein the shell is formed of two opposing pieces joined together.

6. The muffler for the engine according to claim 1, further comprising:

grooves formed in the outer surface of the shell, a respective groove located proximate each longitudinal edge of the reinforcing plate.

7. The muffler for the engine according to claim 1, further comprising:

a pair of grooves formed in the outer surface of the shell, the pair of grooves located such that the flange portion of the partition wall is positioned between grooves of the pair of grooves.

* * * * *